US008573108B2

(12) United States Patent
Ohlson

(10) Patent No.: US 8,573,108 B2
(45) Date of Patent: Nov. 5, 2013

(54) DESTRUCTION CHAMBER WITH REPLACEABLE INNER FRAGMENTATION PROTECTION IN THE FORM OF A LARGE NUMBER OF INDIVIDUALLY EASILY HANDLED SEGMENTS, COMBINED WITH ONE ANOTHER TO FORM ONE UNIT

(75) Inventor: Johnny Ohlson, Kil (SE)

(73) Assignee: Dynasafe International AB, Stockholm (SE)

( * ) Notice: Subject to any disclaimer, the term of this patent is extended or adjusted under 35 U.S.C. 154(b) by 469 days.

(21) Appl. No.: 12/282,901

(22) PCT Filed: Feb. 19, 2007

(86) PCT No.: PCT/SE2007/000143

§ 371 (c)(1),
(2), (4) Date: Oct. 8, 2008

(87) PCT Pub. No.: WO2007/106007

PCT Pub. Date: Sep. 20, 2007

(65) Prior Publication Data

US 2009/0044693 A1 Feb. 19, 2009

(30) Foreign Application Priority Data

Mar. 16, 2006 (SE) ..... 0600576

(51) Int. Cl.
*F42D 5/045* (2006.01)

(52) U.S. Cl.
USPC ..... 86/50

(58) Field of Classification Search
USPC ..... 86/50; 220/4.11, 4.04, 4.06–4.09, 4.25, 220/4.24, 4.31, 88.1, 581, 584, 585, 654, 220/652, 651, 639, 560.1; 102/303
See application file for complete search history.

(56) References Cited

U.S. PATENT DOCUMENTS 1,696,112 A * 12/1928 George ..... 220/4.11
1,732,128 A * 10/1929 Howcott ..... 220/4.11

(Continued)

FOREIGN PATENT DOCUMENTS

DE 4240394 A1 6/1994
DE 19521204 C1 9/1996

(Continued)

OTHER PUBLICATIONS

Supplementary European Search Report dated Feb. 20, 2012, in European Application No. 07709358.

*Primary Examiner* — Michael Carone
*Assistant Examiner* — Reginald Tillman, Jr.
(74) *Attorney, Agent, or Firm* — Novak Druce Connlly Bove + Quigg LLP

(57) ABSTRACT

The present invention relates to a new method for providing a destruction or detonation chamber (1, 9 and 27) intended for the destruction of ammunition products and other explosive products with an easily replaceable internal detonation and fragmentation protection (23-25). A particular characteristic of the detonation and fragmentation protection (23-25) according to the invention is that it comprises a large number of identical segments, which can take the form of a small number of interacting and mutually complementary variants, and which are all characterized in that they are relatively easy to handle and can be delivered to the interior of the destruction chamber (1, 9 and 27), where they are fitted in place through the closeable aperture (29), which in operation of the destruction chamber is used to charge the explosive material that is to be destroyed therein.

24 Claims, 3 Drawing Sheets

(56) References Cited

U.S. PATENT DOCUMENTS

Figure 1:
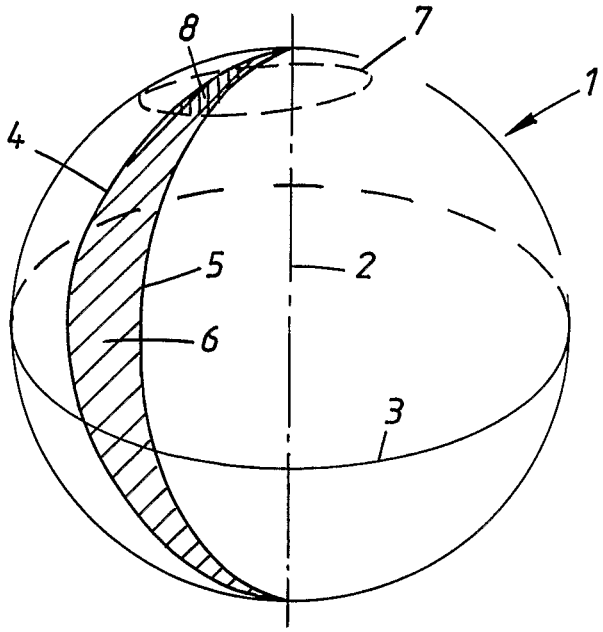

| | | | | |
|---|---|---|---|---|
| 2,118,388 | A * | 5/1938 | Zerbe | 228/105 |
| 2,844,939 | A * | 7/1958 | Schultz | 60/257 |
| 3,108,704 | A * | 10/1963 | Rooney et al. | 220/565 |
| 3,239,092 | A * | 3/1966 | Levenetz | 220/590 |
| 3,291,437 | A * | 12/1966 | Bowden et al. | 249/48 |
| 4,478,126 | A * | 10/1984 | Holmlund et al. | 86/50 |
| 4,651,401 | A * | 3/1987 | Arbella | 29/429 |
| 5,404,793 | A * | 4/1995 | Myers | 92/169.1 |
| 7,311,790 | B2 * | 12/2007 | Morrison et al. | 156/89.11 |
| 2003/0209133 | A1 * | 11/2003 | Greenfield et al. | 86/50 |
| 2005/0188825 | A1 * | 9/2005 | Sharpe et al. | 86/50 |
| 2005/0223881 | A1 * | 10/2005 | Cirillo | 86/50 |
| 2009/0126555 | A1 * | 5/2009 | Olsson | 86/50 |

FOREIGN PATENT DOCUMENTS

| | | |
|---|---|---|
| DE | 19606945 | 7/1997 |
| SE | 465482 | 9/1991 |
| SE | 507663 | 6/1998 |
| WO | WO-97-43594 A1 | 11/1997 |
| WO | WO-2006049550 | 5/2006 |

* cited by examiner

DESTRUCTION CHAMBER WITH REPLACEABLE INNER FRAGMENTATION PROTECTION IN THE FORM OF A LARGE NUMBER OF INDIVIDUALLY EASILY HANDLED SEGMENTS, COMBINED WITH ONE ANOTHER TO FORM ONE UNIT

This application is a National Stage of PCT/SE2007/000143 filed Feb. 19, 2007 which in turn claims priority from Swedish Application 0600576-3 filed Mar. 16, 2006.

The present invention relates to a new method for providing a destruction or detonation chamber intended for the destruction of ammunition products and other explosive products with an easily replaceable internal detonation and fragmentation protection. A particular characteristic of the detonation and fragmentation protection according to the invention is that it comprises a large number of identical segments, which can take the form of a small number of interacting and mutually complementary variants, and which are all characterized in that they are relatively easy to handle and can be delivered to the interior of the destruction chamber, where they are fitted in place through the closeable aperture, which in operation of the destruction chamber is used to charge the explosive material that is to be destroyed therein.

Since the passing of the cold war, there are at many locations throughout the world large stocks of old, obsolete ammunition such as artillery shells, land mines etc., which no longer fulfill any function and which it would be best to dispose of, and which can hardly be scrapped in any way other than by detonation and burning. This may involve cartridge ammunition which is of too small a calibre to allow it to be cost-effectively dismantled, or those ammunition components which through protracted storage under unfavourable conditions have become far too unsafe for anybody to dare to dismantle them and to melt out the constituent explosives. Another factor is the desire to capitalize on all valuable scrap metal which these ammunition components generally contain.

From once having detonated such ammunition out in the open or sunk it out at sea, in deep waters or in abandoned mines, where the environmentally harmful components which it often as not contains could over time have contaminated the environment, fortunately we have now largely gone over to destroying it, that is to say detonating such surplus ammunition in special, purpose-made destruction facilities, which make it possible to utilize all the scrap formed in the process and to purify all the environmentally harmful combustion gases simultaneously generated. The destruction is performed as a combined detonation and combustion process, which destroys all the explosives that once went into the original ammunition, the end product therefore being harmless scrap metal, which can be recycled.

In very general terms the main component of destruction facilities of the aforementioned type consists of a fragmentation, pressure and heat-resistant destruction chamber, in which the constituent explosives of the ammunition that is to be destroyed are detonated and/or burned. Since the combustion gases formed in the combustion of the constituent explosives of the ammunition destroyed are normally more or less harmful to health and large quantities of such gases are generated in one place, that is to say in the destruction chamber, this must be made gas-tight so that the combustion gases can be managed and purified before they are discharged into the atmosphere. This means that the detonation chamber must withstand both the fragments formed in detonation of the ammunition and high pulsating pressures and high temperatures. The wear and tear on such destruction chambers therefore becomes so great that in most cases it is necessary to divide the wall structure of the chamber up into a replaceable fragmentation and shock wave-absorbing inner shell and a pressure-absorbing, gas-tight outer shell.

The most advantageous shape for a destruction chamber with regard to all pressure waves like the constantly-recurring explosions from detonating explosives would probably be a spherical shape, but this is also difficult and expensive to produce. A suitable compromise was then found to be a chamber which comprises a relatively short cylindrical tube-shaped centre part, which at each of its ends merges into end parts of a truncated cone shape, with normally closed plane end sides. With detonations close to the centre of the destruction chamber, this destruction chamber shape affords approximately equal distance for the pressure waves to travel before they reach the chamber walls, which means that the pressure stresses will in principle be equal everywhere on the chamber walls. The disadvantage of this type of destruction chamber is that it is very awkward to equip with replaceable internal fragmentation protection, especially as the only openable inlets and outlets that can normally be allowed in such a destruction chamber must be located in the plane end sides of the truncated cone end parts. These openable inlets and outlets will also therefore be those that will be used for charging the material for destruction and for removing the scrap metal obtained after destruction.

Regardless of what form the destruction chamber now takes, the problem arises of providing it with a replaceable, fragmentation-absorbing inner shell, old worn parts of which can be removed from the chamber and new ones provided through an existing, openable inlet and/or outlet, that is to say without having to divide the gas-tight and therefore preferably fully welded outer shell of the destruction chamber up into parts. Obviously, for practical reasons the destruction chamber aperture can never be made with the same width as the interior of the chamber, whilst the interior of the chamber must have a certain volume so as to be able to absorb the pressure waves formed by detonation of the material for destruction.

The present invention therefore now relates to a method for providing the destruction chambers in such destruction facilities with a new type of internal fragmentation and wear protection. The really major advantage of the fragmentation and wear protection according to the invention is that despite the fact that it comprises a large number of different parts or segments, according to the basic principle of the invention nearly all of these parts or segments have an identical shape. Indeed according to a development of the invention, these segments may exist in just a few, preferably two, identical shapes that can be combined with one another within each segment type. In addition to the various segments that can be combined with one another to form a unit, the fragmentation and wear protection according to the invention also includes special locking parts, which together with the fragmentation protection segments make the entire construction self-locking. Of these locking parts, one preferably has a tubular shape and this is placed directly inside the openable inlet of the destruction chamber, whilst the other takes the form of a plane, circular plate, which is internally placed on top of the plane end side of the destruction chamber opposite its inlet. The function of the two locking parts is to prevent the respective ends of the fragmentation protection segments shifting inwards towards the interior of the chamber and the segments are thereby fixed in their respective places. With the locking parts fitted, therefore, each segment of the fragmentation protection bears with its one inner end against the edge of the plane, circular locking element and with its other outer end against the tubular locking element on a level with the outlet of the destruction chamber.

All segments of the fragmentation protection are moreover each of a design shape such that, once they are worn out, they can easily be removed through the aperture, which in operation is used for introducing ammunition components that are to be destroyed, and in the same way the replacement parts can easily be introduced through the same charging aperture. The invention further encompasses a method for ensuring that these individually introduced fragmentation and wear protection segments, once placed inside the destruction chamber, together form a continuous protective layer that gives the outer pressure shell of the destruction chamber an extraordinarily good internal protection against all fragments formed and dispersed in the interior of the destruction chamber and the pressure waves that are released by the detonations which give rise to the fragmentation, and naturally also to some extent against the heat that is given off in the destruction chamber.

According to the present invention, which therefore applies generally to all destruction and detonation chambers of circular cross section, the fragmentation and wear protection used to line said chamber comprises a larger number of identical parts as segments, which are arranged around the inside of the chamber bearing tightly against one another and each of which, curved but if necessary divided by sharp corners into multiple, firmly interconnected straight parts, extends from the area close to the axis of the circular cross section at one end of the detonation chamber into the vicinity of the same axis at the other end of the detonation chamber.

The basic principle of the invention may be said to be a method for providing a spherical destruction chamber with an internal protective layer comprising a plurality of segments, which can be introduced through a circular aperture of limited diameter arranged around one axis of the sphere. Each such segment is thereby characterized in that it virtually has the shape of and, once fitted in place, is intended to cover the area between two median lines of the sphere. As the surface between two medians, this basic shape can then in turn be modified by a truncation at each of its tapered ends, so that it fulfils the same function when the basic spherical shape is modified to form a sphere that is truncated and partially flattened around its respective axial passages. Each segment forming part of such a protective layer will therefore have the shape of a curved beam with two edge sides remote from one another, the shape of which coincides with the aforesaid meridian lines, and two curved broad sides remote from one another, an outer one facing outwards and an inner one facing inwards, of which the outer one must be adapted to bear against the inside of the gas-tight outer shell of the destruction chamber and the other inner one is intended to face inwards towards the interior of the destruction chamber. When fitted in place, therefore, these curved beam elements each cover a smaller part of the inner wall area of the destruction chamber, but owing to the fact that their edge sides follow the median lines, they can be made to bear tightly against one another, so that together they form a continuous lining of the inside of the destruction chamber, which extends from the area close to the centre axis at one end of the destruction chamber into the area close to the axis of the destruction chamber at its other end. If the spherical shape of the destruction chamber is truncated and flattened towards the ends around its own axis, these parts must therefore be covered in some other way and according to the basic principle of the invention this is done by means of integral special locking parts. Normally, it is the inlet aperture of the destruction chamber and its opposite truncated end which will not be covered by the curved beam segments according to the invention.

The same basic idea as has been described above can furthermore be used when said destruction chamber is modified to form a body having a tubular middle part and two truncated cone end parts, or a purely cylindrical main part with plane end sides. In both of the latter two cases the segments or beams will only have straight edge and broad sides with a middle or centre part of uniform width and two successively tapering end parts.

In order to obtain the best possible sealing between the aforesaid beam elements bearing tightly against one another, these may be alternately provided, at least along parts of their opposing edges, with projecting male flanges and recessed female grooves, which when the beam elements are brought to bear against one another engage in one another. This ancillary concept therefore means that either each beam element must have a male and a female side or, as will probably be most suitable in most cases, that male and female beam elements are used alternately, each denoted according to how its bearing edges resting against the next beam element are formed.

Once the beam elements forming the fragmentation and wear protection according to the invention have been placed in their respective locations with their meridian-like edge sides bearing tightly against one another, so that together they completely cover the inside of the detonation chamber, these elements must be fixed in place which, when the destruction chamber is of the double cone type earlier described, is done with an inner locking part in the form of a cylindrical plate, against the outer edge of which the inner edge ends of the various beam elements rest, and a cylindrical locking ring, which on the inside of the detonation chamber surrounds its charging aperture and along its edge side facing the interior of the chamber fixes the outer edge ends of the beam elements.

Figure 5:
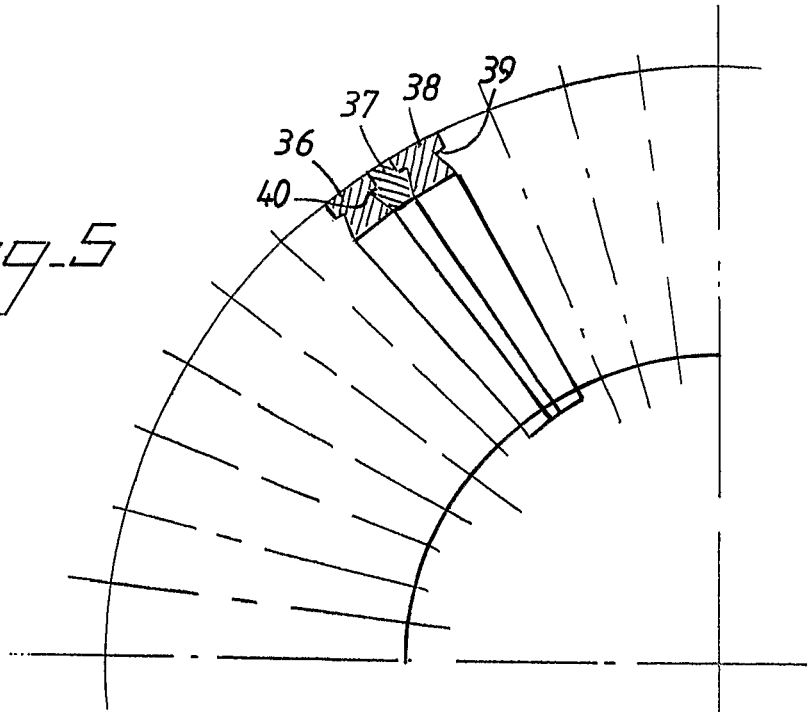
Figure 2:
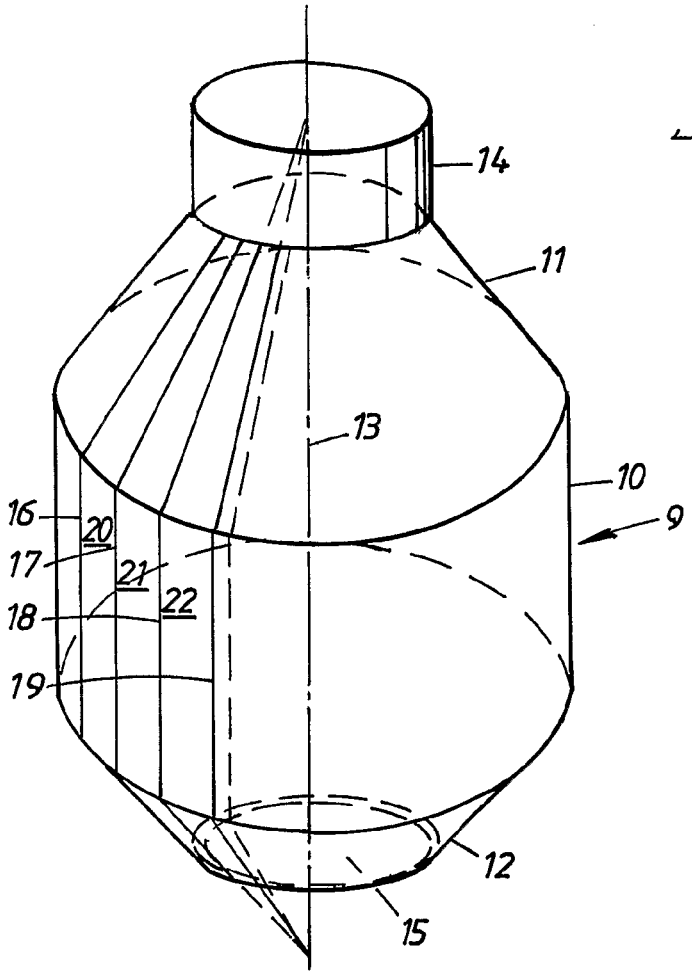
Figure 3:
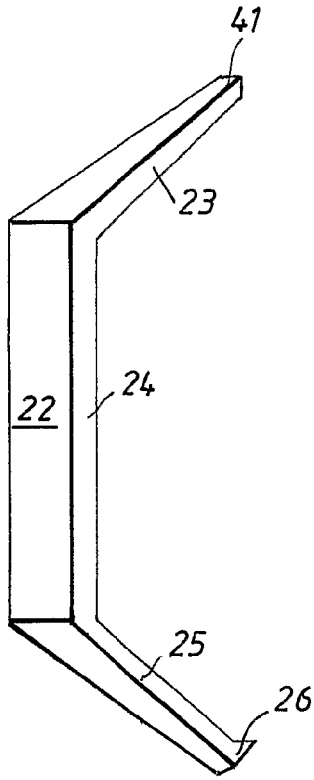
Figure 4:
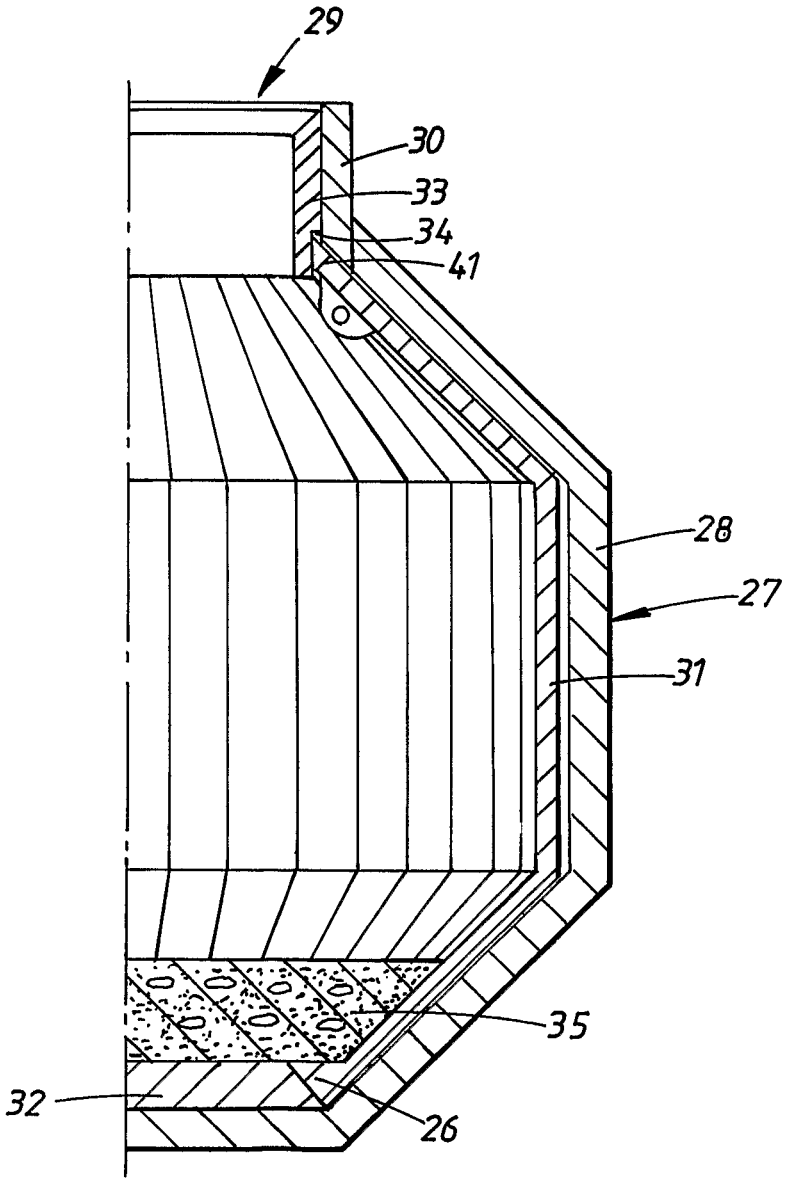

The invention has been more closely specified in the following patent claims and will now be described in somewhat more detail with reference to the drawings attached in which:

FIG. 1 in an oblique projection shows the meridian lines of a sphere and the surface bounded by two curved lines between two meridians, FIG. 2 in an oblique projection and partially sectional form shows a destruction chamber, the internal shape of which is characterized by a shorter cylindrical part and two end parts in the form of truncated cones, FIG. 3 in an oblique projection shows a fragmentation protection segment which forms part of the arrangement according to FIG. 2, FIG. 4 shows the right-hand half of a longitudinal section through a destruction chamber of the type shown in FIG. 2, and FIG. 5 shows a cross section through a quadrant of the destruction chamber shown in FIG. 4, but is here provided with fragmentation protection segments of modified type.

Reference will first be made to FIG. 1, which shows a sphere 1 with an axis 2, and an equator line 3, two median lines 4 and 5 being drawn in and these lines between them defining the area 6. This is because the basic idea of the invention is based on the use of detached beam elements, the opposing edge sides of which follow imaginary median lines (that is to say, in principle, the lines 4 and 5) on a spherical or originally spherical destruction chamber subsequently more or less heavily modified to its final shape. Assembled in their imagined locations according to the invention, the beam elements are fitted tightly against one another along the inside of the gas-tight outer shell of the destruction chamber and thereby form a continuous, easily replaceable fragmentation and detonation protection, in which each beam element in principle therefore covers the area between two median lines, which can in principle be compared to the area 6 in FIG. 1.

If the basic spherical shape has then been truncated by a flattening around one or the other axial passages, for example of the access aperture, here indicated by 7, and is therefore not covered by a more or less fixed lining, the area that is covered by a beam element of the type characteristic of the invention must be bounded to a corresponding degree. In the figure the bounded area is indicated by 8.

Spherical destruction chambers, however, are less common, primarily because they are so expensive and difficult to produce. However, the basic principles of the invention also function excellently in destruction chambers with a modified spherical shape, for example of the type shown in FIG. 2. For the sake of clarity only the inside of the gas-tight and fully welded outer shell of the detonation chamber has been drawn in the figure. The inside of this outer shell has precisely the same shape as shown on the drawing and the beam elements characteristic of the invention are intended to bear against this inside. The basic shape of this destruction chamber therefore comprises a cylindrical centre part 10 and two truncated cone end parts 11 and 12. The axis of the destruction chamber is denoted by 13. The end part 11 is outwardly closed off by an admission tube 14, whilst the end part 12 is outwardly closed off by a plane bottom plate 15. In the drawing four median lines 16-19 are furthermore drawn in. These median lines show the boundary edges of three fragmentation and detonation protection beam elements 20-22 drawn in the figure. The direct shape of the beam elements 20-22 and thus the entire orbit around the inside of the destruction chamber can be seen even better from FIG. 3.

As can be seen from FIG. 3, each such beam element in the destruction chamber of the type shown in FIG. 2 comprises three firmly interconnected beam parts 23-25 angled in relation to one another, of which the middle element 24 is of entirely uniform width over its whole length, whilst the two outer elements 23 and 25 taper towards their ends in proportion to the radii to the axis of the chamber. It can also be seen that the lower beam part 25 is terminated by a heel 26, the use of which can be seen from FIG. 4, which accordingly shows a longitudinal section through the right-hand half of a destruction chamber of the type shown in FIG. 2.

In the half of the destruction chamber shown in FIG. 4 it is possible to identify the gas-tight, fully welded outer shell 28 of the chamber 27 provided with a charging aperture 29 surrounded by a tubular neck part 30. A beam element of the same type as the beam elements 20-22 can also be seen inside the chamber. The beam element has here been denoted by 31. The same lower beam heel 26 as in FIG. 3 can also be seen here. And as can be seen from the drawing, it here locks against a circular, loosely inserted bottom plate 32 provided with a tapered edge. Its interacting, obliquely chamfered edges mean that the bottom plate and the various beam elements interlock. At the upper edge 41 of the beam elements, these are then in turn locked by a tubular locking part 33, which is inserted into the tubular neck part of the charging aperture and is prevented from falling into the chamber by a locking edge 34. Also visible from the drawing is a lifting loop fixed to the beam element 31 and some scrap 35 from originally explosive material already destroyed that has previously collected in the chamber.

Referring then to FIG. 5, it is interesting to note from this figure that here the beam elements, with their cross section in the drawing denoted by 36-38, are of two different types, of which 36 and 38 are identically formed along their respective side edges with recessing female grooves, here denoted by 39, into which similarly laterally projecting male flanges 40 of intervening beam elements 37 are inserted. Together, the female grooves 39 and the male flanges 40 form simple but effective labyrinth seals for the shock waves and the combustion gases formed by the destruction of the explosive material. These female grooves and male flanges thus constitute a further development of the invention.

The invention claimed is:

1. A method for forming a replaceable fragmentation absorbing inner shell in combination with a destruction chamber for the destruction of explosive-filled bodies, wherein the destruction chamber has a cylindrical center part and two truncated end parts, the method comprising:

providing a plurality of replaceable curved beam elements, each curved beam element is configured to be arranged tightly against one another, side-by-side along the inside of the destruction chamber, wherein each beam element includes a plurality of interconnected parts, wherein the broad sides of the beam elements facing the interior of the destruction chamber are configured to conform to the shape of the destruction chamber, and providing the inner shell and destruction chamber with a means for locking, wherein the means for locking is configured to render replaceable curved beam elements self-locking within the destruction chamber.

2. Method according to claim 1, comprising once arranged tightly against one another along the inside of the destruction chamber, the curved beam elements are fixed in place at inner and outer ends.

3. Method according to claim 2, comprising when the destruction chamber has a modified spherical shape with a central cylindrical intermediate part and two truncated cone end parts pointed in either direction, the beam elements which together form the inner shell of the destruction chamber, are in the form of a shape comprising a central straight middle part of uniform width, which is solidly united with two outer beam parts tapering towards their respective free outer ends and angled in relation to the middle part, but directed around the same dividing plane.

4. Method according to claim 2 for securely fixing all beam elements arranged in the interior of a destruction chamber, which together form a continuous, unbroken fragmentation and detonation protection, comprising the curved beam elements used for this purpose are fixed in their respective locations firstly with their inner ends against a circular outer edge of a protective plate inserted against an inner plane end surface of the destruction chamber at an inner termination of a truncated cone end part, and secondly with outer ends of the beam elements against an annular locking element, which internally surrounds a closeable charging aperture of the detonation chamber arranged at an outer end thereof.

5. Method according claim 1, wherein the beam elements have opposing edges and comprising along their opposing edges the beam elements bearing tightly against one another are alternately formed with projecting male flanges or recessed female grooves, which are matched to one another and which when the beam elements bear against one another engage in one another and thereby form simple labyrinth seals for the detonation and pressurized gas waves generated in the destruction chamber.

6. Method according to claim 4, wherein the curved beam elements used for lining the destruction chamber are designed in two main types, which are arranged alternately around the inside of the destruction chamber, every other one being formed either with male flanges or female grooves.

7. Method according to claim 2, comprising along their opposing edges the beam elements bearing tightly against one another are alternately formed with projecting male flanges or recessed female grooves, which are matched to one another and which when the beam elements bear against one another engage in one another and thereby form simple labyrinth seals for the detonation and pressurized gas waves generated in the destruction chamber.

8. Method according to claim 3, comprising along their opposing edges the beam elements bearing tightly against one another are alternately formed with projecting male flanges or recessed female grooves, which are matched to one another and which when the beam elements bear against one another engage in one another and thereby form simple labyrinth seals for the detonation and pressurized gas waves generated in the destruction chamber.

9. Method according to claim 7, comprising the curved beam elements used for lining the destruction chamber are designed in two main types, which are arranged alternately around the inside of the destruction chamber, every other one being formed either with male flanges or female grooves.

10. Method according to claim 8, comprising the curved beam elements used for lining the destruction chamber are designed in two main types, which are arranged alternately around the inside of the destruction chamber, every other one being formed either with male flanges or female grooves.

11. Method according to claim 1, wherein the means for locking comprises a cylindrical plate inner locking part having an outer edge upon which inner edge ends of the beam elements rest; and a tubular locking part for fixing outer edge ends of the beam elements.

12. Method according to claim 11, wherein the beam elements have a heel at their lower ends, which lock against a bottom plate having a tapered edge.

13. A fragmentation and detonation protection system in combination with a destruction chamber for destroying ammunition and explosive products, said destruction chamber having a cylindrical center part and two truncated end parts, wherein the fragmentation and detonation protection comprises:

a replaceable inner shell, wherein the replaceable inner shell includes a plurality of replaceable curved beam elements, each beam element is configured to be arranged tightly against one another, side-by-side along the inside of the destruction chamber, wherein each beam element includes a plurality of interconnected parts, wherein the broad sides of the beam elements facing the interior of the destruction chamber are configured to conform to the shape of the destruction chamber, and wherein the replaceable inner shell and destruction chamber further includes a means for locking, wherein the means for locking is configured to render the beam elements self-locking within the destruction chamber.

14. Fragmentation and detonation protection in combination with a destruction chamber for destroying ammunition and explosive products according to claim 13, comprising adjoining the beam elements are alternately formed with projecting male flanges or recessed female grooves, which when the beams bear against one another form labyrinth seals for pressure waves and combustion gases generated inside the destruction chamber.

15. Fragmentation and detonation protection in combination with a destruction chamber for destroying ammunition and explosive products according to claim 13, comprising each beam element is provided with a lifting loop arranged at a point with a suitable centre of gravity for crane handling of the beam element.

16. Fragmentation and detonation protection system in combination with a destruction chamber for destroying ammunition and other explosive products according to claim 13, wherein once arranged tightly against one another for along the inside of the destruction chamber, the curved beam elements are fixed in place at inner and outer ends.

17. Fragmentation and detonation protection system in combination with a destruction chamber for destroying ammunition and explosive products according to claim 13, wherein when the destruction chamber to be protected has a modified spherical shape with a central cylindrical intermediate part and two truncated cone end parts pointed in either direction, the beam elements are in the form of a shape comprising a central straight middle part of uniform width, which is solidly united with two outer beam parts tapering towards their respective free outer ends and angled in relation to the middle part, but directed around the same dividing plane.

18. Fragmentation and detonation protection system in combination with a destruction chamber for destroying ammunition and explosive products according to claim 13, wherein the curved beam elements used for forming a continuous, unbroken fragmentation and detonation protection are for being fixed in their respective locations firstly with their inner ends against the circular outer edge of a protective plate inserted against the inner plane end surface of the destruction chamber at the inner termination of the truncated cone end part, and secondly with the outer ends of the beam elements against an annular locking element, which internally surrounds a closeable charging aperture of the detonation chamber arranged at the outer end thereof.

19. Fragmentation and detonation protection system in combination with a destruction chamber for destroying ammunition and explosive products according to claim 13, wherein along their opposing edges the beam elements bearing tightly against one another are alternately formed with projecting male flanges or recessed female grooves, which are matched to one another and which when the beam elements bear against one another engage in one another and thereby form simple labyrinth seals for the detonation and pressurized gas waves generated in the destruction chamber.

20. Fragmentation and detonation protection system in combination with a destruction chamber for destroying ammunition and explosive products according to claim 13, wherein the curved beam elements for lining the destruction chamber are designed in two main types, which are for arranging alternately around the inside of the destruction chamber, every other one being formed either with male flanges or female grooves.

21. Fragmentation and detonation protection system in combination with a destruction chamber for destroying ammunition and explosive products according to claim 14, comprising each beam element is provided with a fixing point arranged at a point with a suitable centre of gravity for crane handling of the beam element.

22. Fragmentation and detonation protection system in combination with a destruction chamber for destroying ammunition and explosive products according to claim 13, wherein along their opposing edges the beam elements bearing tightly against one another are alternately formed with projecting male flanges or recessed female grooves, which are matched to one another and which when the beam elements bear against one another engage in one another and thereby form simple labyrinth seals for the detonation and pressurized gas waves generated in the destruction chamber.

23. Fragmentation and detonation protection system in combination with a destruction chamber for destroying ammunition and explosive products according to claim 13, wherein the means for locking comprises a cylindrical plate inner locking part having an outer edge upon which inner edge ends of the beam elements rest; and a tubular locking part for fixing outer edge ends of the beam elements.

24. Fragmentation and detonation protection system in combination with a destruction chamber for destroying ammunition and explosive products according to claim 23, wherein the beam elements have a heel at their lower ends, which lock against a bottom plate having a tapered edge.

* * * * *